US009396842B2

(12) United States Patent
Yamada et al.

(10) Patent No.: US 9,396,842 B2
(45) Date of Patent: Jul. 19, 2016

(54) FLEXIBLE FLAT CABLE AND METHOD OF MANUFACTURING THE SAME

(71) Applicant: Yazaki Corporation, Minatu-ku, Tokyo (JP)

(72) Inventors: Maki Yamada, Susono (JP); Toshiro Suzuki, Susono (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 14/291,093

(22) Filed: May 30, 2014

(65) Prior Publication Data

US 2014/0262430 A1 Sep. 18, 2014

Related U.S. Application Data

(63) Continuation of application No. PCT/JP2012/081716, filed on Nov. 30, 2012.

(30) Foreign Application Priority Data

Dec. 1, 2011 (JP) ..... 2011-263707

(51) Int. Cl.

| | |
|---|---|
| ***H01B 7/00*** | (2006.01) |
| ***H01B 13/00*** | (2006.01) |
| ***H01B 3/44*** | (2006.01) |

(Continued)

(52) U.S. Cl.

CPC ..... *H01B 13/0013* (2013.01); *H01B 3/44* (2013.01); *H01B 3/443* (2013.01); *H01B 7/04* (2013.01); *H01B 7/08* (2013.01); *H01B 7/0823* (2013.01)

(58) Field of Classification Search

CPC ..... H01B 7/00; H01B 11/00
USPC .... 174/110 R, 110 AR–110 V, 113 R, 117 R, 174/117 F, 117 FF, 120 R, 120 SR
See application file for complete search history.

(56) References Cited

U.S. PATENT DOCUMENTS

| | | | | |
|---|---|---|---|---|
| 4,337,324 A | | 6/1982 | Yusa et al. | |
| 4,468,089 A | | 8/1984 | Brorein | |
| 4,783,579 A | * | 11/1988 | Brandolf | B29C 47/0019 156/55 |

(Continued)

FOREIGN PATENT DOCUMENTS

| | | |
|---|---|---|
| CN | 1344978 A | 4/2002 |
| CN | 101386697 A | 3/2009 |

(Continued)

OTHER PUBLICATIONS

Influence of matrix polymer on melt strength and viscosity of wood flour reinforced composites, M Kozlowski, S Szczurek, T Szczurek, S Frackowiak, pp. 751-754, Mar. 29, 2008.*

(Continued)

*Primary Examiner* — William H Mayo, III
(74) *Attorney, Agent, or Firm* — Banner & Witcoff, Ltd.

(57) ABSTRACT

A flexible flat cable includes an insulating layer disposed through extrusion in vicinity of a plurality of conductors arrayed in parallel with each other. The insulating layer is composed of a vinyl chloride-based resin composition having a die swell ratio of 1.1 or more at a molding temperature during the extrusion. The molding temperature is between 150° C. to 200° C. with a linear rate of between 50 m/minute to 200 m/minute. A melt tension of the vinyl chloride-based resin composition is 0.02 N to 0.2 N.

8 Claims, 3 Drawing Sheets

(51) Int. Cl.

| | |
|---|---|
| ***H01B 7/04*** | (2006.01) |
| *H01B 7/08* | (2006.01) |

(56) References Cited

U.S. PATENT DOCUMENTS

| | | | | | |
|---|---|---|---|---|---|
| 4,835,394 | A | * | 5/1989 | Steele | 250/385.1 |
| 4,888,148 | A | | 12/1989 | Hartitz | |
| 4,992,311 | A | * | 2/1991 | Hisazumi et al. | 428/35.4 |
| 5,091,610 | A | * | 2/1992 | Strauss | 174/117 F |
| 5,304,741 | A | * | 4/1994 | Proulx | H01B 7/0823 174/110 FC |
| 5,360,944 | A | * | 11/1994 | Springer et al. | 174/117 F |
| 5,428,189 | A | * | 6/1995 | Dorner | B60R 16/0207 174/115 |
| 6,271,301 | B1 | * | 8/2001 | Weng et al. | 524/527 |
| 6,344,532 | B1 | * | 2/2002 | Kim et al. | 526/344 |
| 2002/0061210 | A1 | | 5/2002 | Ashibe et al. | |
| 2010/0044071 | A1 | | 2/2010 | Murao et al. | |

FOREIGN PATENT DOCUMENTS

| | | | | | |
|---|---|---|---|---|---|
| CN | 101536117 | A | | 9/2009 | |
| CN | 101781434 | A | | 7/2010 | |
| JP | S56-104954 | A | | 8/1981 | |
| JP | H01-276514 | A | | 11/1989 | |
| JP | H10-278206 | A | | 10/1998 | |
| JP | 2003-064232 | A | * | 3/2003 | C08L 27/06 |
| JP | WO2008/056772 | A1 | * | 5/2008 | H01B 7/08 |
| WO | 2008056772 | A1 | | 5/2008 | |

OTHER PUBLICATIONS

International Search Report issued in International Application No. PCT/JP2012/081716 mailed Apr. 29, 2013.

Written Opinion issued in International Patent Application No. PCT/JP2012/081716 mailed Apr. 29, 2013.

Oct. 30, 2015—(JP) Notification of Reasons for Refusal—App 2011-263707.

Jan. 20, 2016—(JP) Decision of Refusal—App 2011-263707, Eng Tran.

Aug. 3, 2015—(CN) Notification of the First Office Action—App 201280058914.2, Eng Tran.

* cited by examiner

FLEXIBLE FLAT CABLE AND METHOD OF MANUFACTURING THE SAME

CROSS REFERENCE TO RELATED APPLICATIONS

This application is a continuation of PCT application No. PCT/JP2012/081716, which was filed on Nov. 30, 2012 based on Japanese Patent Application (No. 2011-263707) filed on Dec. 1, 2011, the contents of which are incorporated herein by reference.

BACKGROUND OF THE INVENTION

1. Field of the Invention

The present invention relates to a flexible flat cable, and particularly to a flexible flat cable manufactured through extrusion.

2. Description of the Related Art

A flexible flat cable is used to electrically connect, for example, a moving portion and a fixed portion due to its flexibility, is very flexible in terms of shape, only requires a small space, and can be easily wound as necessary. Due to the above advantages, a flexible flat cable has an extremely wide range of uses such as the connection between a scanner head, a printer head, or the like and a main body portion which is a fixed portion, and a clock spring in an automobile.

Such a flexible flat cable was frequently manufactured using a lamination method. Such a method includes the technique proposed in JP-A-10-278206. That is, the technique is to laminate a conductor using a composite sheet which is manufactured by laminating a heat seal layer composed of a heat seal resin on a base material sheet composed of a saturated polyester resin imparted with fire retardance.

Here, high sliding curvature characteristics that a flexible flat cable needs to have were obtained from the heat seal layer, and sufficient adhesion properties to a conductor was secured.

However, the above method has a number of processes such as a base material sheet manufacturing process, a heat seal layer forming process, and a lamination process, the manufacturing costs become extremely high compared to, for example, a coated wire manufactured through ordinary extrusion, and, while having been used as a component that requires extremely high curvature resistance (for example, ten million times or more) such as a clock spring in the automobile field, the flexible flat cable has rarely been applied to doors such as a slide door whose thickness and size can be decreased through use of the flexible flat cable.

Here, International Publication WO2008/056772 (Patent Document 1) proposes a technique in which a flexible flat cable is manufactured using a thermoplastic resin having a curvature elastic modulus of equal to or more than 200 MPa to less than 800 MPa through extrusion. According to the technique, a flexible flat cable that is excellent in terms of sliding curvature resistance can be obtained.

However, in a case in which the above thermoplastic resin is used, there was a problem in that it is not possible to coat a conductor with the resin when a thin flexible flat cable is manufactured, or a uniform structure cannot be obtained.

Particularly, in the past, it was not possible to manufacture a thin flexible flat cable having an insulating layer with a thickness of 0.2 mm or less on a conductor which is required for the use of, for example, a narrow cable routing space for automobiles such as appliance cable routing.

CITATION LIST

Patent Literature

[PTL 1] International Publication WO2008/056772

SUMMARY OF THE INVENTION

An object of the invention is to provide a method of manufacturing a flexible flat cable in which the above problem of the related art, that is, in a case in which the above thermoplastic resin is used, it is not possible to coat a conductor with the resin when a thin flexible flat cable is manufactured, or a uniform structure cannot be obtained, is solved.

According to one aspect of the present invention, there is provided a flexible flat cable configured to have an insulating layer disposed through extrusion in vicinity of a plurality of conductors arrayed in parallel with each other, wherein the insulating layer is composed of a vinyl chloride-based resin composition having a die swell ratio of 1.1 or more at a molding temperature during the extrusion, the molding temperature being between 150° C. to 200° C., with a linear rate of between 50 m/minute to 200 m/minute.

In the flexible flat cable as described above, a melt tension of the vinyl chloride-based resin composition may be 0.02 N to 0.2 N.

In the flexible flat cable as described above, a thickness of the conductor may be 0.02 mm to 0.5 mm in a thickness direction of the flexible flat cable, and a thickness of the insulating layer may be 0.02 mm to 0.5 mm at portions in which the conductors are present.

The flexible flat cable as described above may be configured to electrically connect a moving portion and a fixed portion of an automobile.

In a method of manufacturing the flexible flat cable according to above, the insulating layer may be formed through extrusion.

According to the flexible flat cable of the invention, since the insulating layer is composed of a vinyl chloride-based resin composition having a die swell ratio of 1.1 or more at a molding temperature during the extrusion, the flexible flat cable becomes thin and flexible so that the flexible flat cable can be applied to the use of a narrow cable routing space for automobiles.

In addition, according to the flexible flat cable of the invention, the flexible flat cable satisfies requirements for flexibility and insulation reliability, and becomes appropriate particularly for the use of a narrow cable routing space for automobiles.

In addition, according to the flexible flat cable of the invention, the flexible flat cable becomes cheap and excellent in terms of flexibility.

According to the method of manufacturing a flexible flat cable of the invention, it is possible to stably manufacture a thin flexible flat cable that is excellent in terms of flexibility which is required for use of a narrow cable routing space for automobiles at low costs without deterioration of the resin composition.

DETAILED DESCRIPTION OF THE EXEMPLARY EMBODIMENTS

Figure 1:
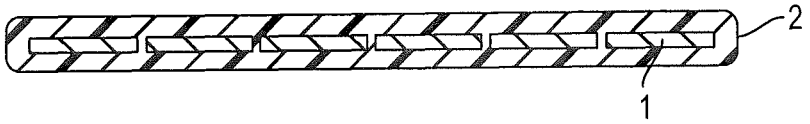
FIG. 1 is a model diagram illustrating the cross-sectional surface of a flexible flat cable according to one embodiment of the invention.

FIG. 1 shows a model diagram illustrating the cross-sectional surface of a flexible flat cable A according to the invention.

In the example, an insulating layer 2 is disposed in the vicinity of six straight angle conductors 1 arrayed in parallel with each other (in the example, straight angle conductors are used, but it is not necessary to use straight angle conductors, and conductors having a round cross-sectional surface (in this case, the thickness of the conductor in the thickness direction of the flexible flat cable becomes the diameter of the conductor) or twisted wire conductors may be used).

As the straight angle conductor 1, the same straight angle conductor as a straight angle conductor used in an ordinary flexible flat cable, that is, a conductor composed of copper, a copper alloy, aluminum, or an aluminum alloy, or the like, or a tin-plated copper conductor can be used.

The thickness of the straight angle conductor is preferably 0.02 mm to 0.5 mm in order to satisfy a sufficient capacity, a strength, and, furthermore, sufficient flexibility as a flexible flat cable. The width of the straight angle conductor is determined depending on the use so as to secure a sufficient capacity; however, at this time, all of the widths of the straight angle conductors do not need to be the same, and are determined depending on necessity. In addition, the number of the straight angle conductors disposed in the flexible flat cable is also determined depending on the use.

The thickness of a resin layer in the flexible flat cable, that is, the thickness of the resin layer at a portion in which the conductors are present is preferably 0.02 mm or more in order to obtain a sufficient strength and sufficient insulation properties, and is preferably 0.5 mm or less so as to obtain sufficient flexibility. The width of the flexible flat cable is appropriately determined depending on the number, use, and the like of the conductors.

The resin layer needs to be composed of a vinyl chloride-based resin composition having a die swell ratio of 1.1 or more at a molding temperature during extrusion. The above configuration makes it possible to manufacture a flexible flat cable having a stable thin portion. In addition, the die swell ratio is preferably 2.0 or less. When the die swell ratio is more than 2.0, pulsation becomes liable to occur, and, at this time, the appearance becomes poor.

Figure 3:
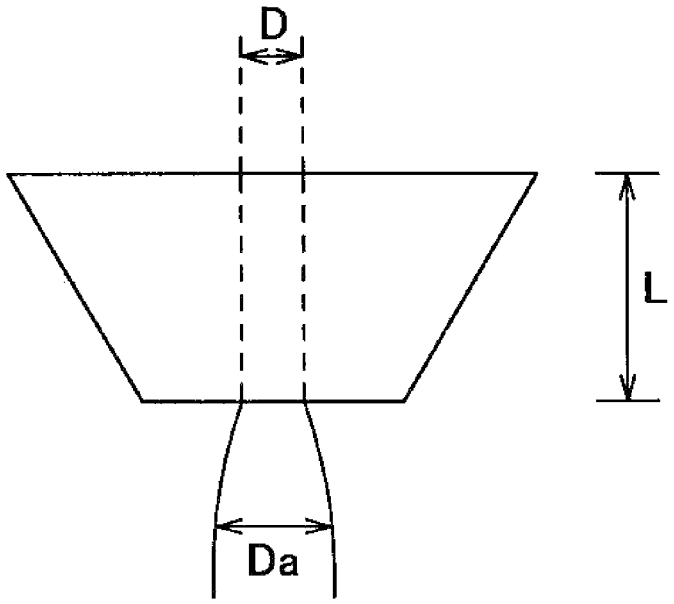
FIG. 3 is a model diagram illustrating the state near the nozzle when the die swell ratio is measured.

In the invention, as the die swell ratio, a value measured and computed based on 4.7.2 in JIS K7199 is used. Specifically, as shown in FIG. 3, for the size Da (mm) (measured at room temperature) of an extruded compact which is obtained when the resin composition is made to pass through a die having a diameter of D (mm) (measured at room temperature) during extrusion using the die, the die swell ratio Sa is computed using the following formula (1). Meanwhile, L in FIG. 3 represents the length (mm) of the die.

[Formula 1]

$$Sa=Da/D \quad (1)$$

The molding temperature during extrusion in the invention specifically refers to the temperature of a nozzle portion in an extruder.

When the die swell ratio is less than 1.1 in the vinyl chloride-based resin composition used in the invention, moldability becomes low, which results in the fact that a thin flexible flat cable that is excellent in terms of flexibility cannot be stably produced.

The insulating layer in the invention needs to be composed of a vinyl chloride-based resin composition. That is, the vinyl chloride-based resin composition has strong acid resistance and alkali resistance, also has favorable water resistance, furthermore, also has a high oxygen index (OI) of 40 to 45, and has fire retardance. Since the vinyl chloride-based resin composition satisfies the above performances that are required for automobile use, and does not need the addition of a flame retardant or a fire retardant aid, use of the vinyl chloride-based resin composition decreases costs, and makes it possible to manufacture a light flat cable. Furthermore, since the vinyl chloride-based resin composition can be processed at a lower temperature (150° C. to 200° C.) than engineering plastic, a flat cable is easily manufactured.

In the vinyl chloride-based resin composition used in the embodiment of the invention, the above die swell ratio can be attained by mixing an appropriate amount of a processing aid with the resin. Examples of the processing aid that is added to a vinyl chloride resin, an ABS resin, polycarbonate, or the like so as to achieves improvement in melt elasticity and acceleration of gelatification of polyvinyl chloride (PVC) include acryl-based high-molecular compounds, acryl-based rubber, polytetrafluoroethylene (PTFE)-based rubber, silicone acryl complex rubber, and the like, and, among them, use of an acryl-based high molecular compound is preferable since gelatification of polyvinyl chloride (PVC) can be accelerated, that is, long chains in the molecule can be entangled with the molecules in the matrix resin so as to form a pseudo crosslink state, thereby supplying melt elasticity. The amount of the processing aid mixed in is preferably 0.5 parts by weight to 5 parts by weight with respect to 100 parts by weight of the base resin. That is, when the mixed amount is less than 0.5 parts by weight, it is difficult to sufficiently improve the die swell ratio, and, when the mixed amount exceeds 5 parts by weight, pulsation becomes liable to occur in the flow of a molten resin during molding, and, at this time, molding becomes poor.

When the vinyl chloride-based resin composition used in the invention has a melt tension which is measured in the following manner of 0.02 N to 0.5 N, it becomes possible to manufacture a flat cable having higher flexibility.

That is, a capillograph 1D PMD-C (manufactured by K.K. Toyo Seiki) set to 180° C. is used, a pellet composed of the resin composition is injected into the cylinder, held for 3 minutes, then, extruded from a capillary at a piston speed of 20 mm/minute, and a material ejected from the capillary is wound using a winding machine at a winding rate of 3.0 mm/minute. The melt tension (N) was measured at this time. Meanwhile, for L/D, the length L of the capillary was set to 10 mm, and the diameter D of the capillary was set to 1.0 mm.

In the vinyl chloride-based resin composition, the melt tension is adjusted by changing the added amount of a plasticizer and the processing aid. When the melt tension is less than 0.02 N, the end portion of the flat cable is liable to be torn, and, when the melt tension exceeds 0.2 N, the flat cable expands, pulsation occurs during molding, and the thickness and width of a product become liable to be varied.

The vinyl chloride-based resin composition used in the invention can be obtained by adding polyvinyl chloride which becomes the base, a plasticizer, a stabilizer, and the processing aid, and kneading them using a variety of roll mills.

The flexible flat cable according to the embodiment of the invention is extruded and molded in the vicinity of a plurality of conductors arrayed in parallel through an extrusion method using a vinyl chloride-based resin composition like the above.

The linear rate is preferably 50 m/minute to 200 m/minute during molding. That is, when the linear rate is below the above range, productivity is low, and, when the linear rate is above the above range, it becomes difficult to manufacture a flexible flat cable having a uniform cross-sectional shape.

EXAMPLES

Hereinafter, examples of the flexible flat cable of the invention will be specifically described.

Elements shown in Table 1 were used as raw materials of a resin composition, and were kneaded using a biaxial kneading extruder or a kneader so as to obtain the mixing amounts (parts by weight) shown in Tables 2 to 4, thereby obtaining 12 kinds of resin compositions.

TABLE 1

| Abbreviation | | |
|---|---|---|
| PVCA | Polyvinyl chloride | TH-2000 manufactured by Taiyo Vinyl Corporation |
| PVCB | Polyvinyl chloride | TH-1400 manufactured by Taiyo Vinyl Corporation |
| PL | Plasticizer | Diundecyl phthalate (DUP) |
| ST | Stabilizer | RUP11 manufactured by ADEKA Corporation |
| KJA | Processing aid (acryl-based high molecular compound) | METABLEN P531A manufactured by Mitsubishi Rayon Co., Ltd. |
| KJB | Processing aid (acryl-based high molecular compound) | METABLEN P551A manufactured by Mitsubishi Rayon Co., Ltd. |

TABLE 2

| | Vinyl chloride-based resin composition | | | | | | | | | |
|---|---|---|---|---|---|---|---|---|---|---|
| | 1 | | | 2 | | | 3 | | 4 | |
| PVCA | 100 | | 100 | | 100 | 100 | 100 | | 100 | 100 |
| PVCB | | 100 | | 100 | | | | 100 | | |
| PL | 30 | 35 | 40 | 40 | 50 | 40 | 40 | 40 | 40 | 50 |
| ST | 6 | 6 | 6 | 6 | 6 | 6 | 6 | 6 | 6 | 6 |
| KJA | 0.5 | 0.5 | 1 | 1 | 1 | 1.25 | 1.25 | 1.25 | 2 | 2 |
| Die swell ratio | 1.10 | 1.20 | 1.25 | 1.26 | 1.26 | 1.27 | 1.27 | 1.29 | 1.30 | 1.30 |
| Melt tension (N) | 0.020 | 0.030 | 0.040 | 0.050 | 0.050 | 0.060 | 0.060 | 0.080 | 0.100 | 0.140 |
| Thickness of straight angle conductor (mm) | 0.15 | 0.02 | 0.10 | 0.10 | 0.10 | 0.15 | 0.35 | 0.035 | 0.15 | 0.05 |
| Resin thickness (mm) | 0.20 | 0.20 | 0.15 | 0.15 | 0.15 | 0.20 | 0.20 | 0.05 | 0.08 | 0.08 |
| Appearance evaluation results | ○ | ○ | ○ | ○ | ○ | ○ | ○ | ○ | ○ | ○ |
| Structure evaluation results | ○ | ○ | ○ | ○ | ○ | ○ | ○ | ○ | ○ | ○ |

TABLE 3

| | Vinyl chloride-based resin composition | | |
|---|---|---|---|
| | 5 | 6 | |
| PVCA | 100 | 100 | |
| PVCB | | | 100 |
| PL | 40 | 40 | 50 |
| ST | 6 | 6 | 6 |
| KJB | 1.5 | 5 | 5 |
| Die swell ratio | 1.2 | 1.8 | 1.8 |
| Melt tension (N) | 0.090 | 0.18 | 0.20 |
| Thickness of straight angle conductor (mm) | 0.10 | 0.15 | 0.05 |
| Resin thickness (mm) | 0.20 | 0.08 | 0.08 |
| Appearance evaluation results | ○ | ○ | ○ |
| Structure evaluation results | ○ | ○ | ○ |

TABLE 4

| | Vinyl chloride-based resin composition | | | | | | | | |
|---|---|---|---|---|---|---|---|---|---|
| | 7 | | 8 | 9 | 10 | | 11 | 12 | |
| PVC | 100 | 100 | 100 | 100 | 100 | | 100 | | 100 |
| | | | | | | 100 | | 100 | |
| PL | 35 | 35 | 40 | 35 | 20 | 20 | 40 | 40 | 40 |
| ST | 6 | 6 | 6 | 6 | 6 | 6 | 6 | 6 | 6 |
| KJA | 0.3 | 0.3 | 0.2 | 0.2 | 0.2 | 0.2 | 10 | 15 | 15 |
| Die swell ratio | 1.05 | 1.05 | 1.03 | 1.02 | 1.01 | 1.02 | 1.4 | 2.3 | 2.1 |
| Melt tension (N) | 0.05 | 0.05 | 0.015 | 0.015 | 0.01 | 0.01 | 0.24 | 0.28 | 0.29 |
| Thickness of straight angle conductor (mm) | 0.10 | 0.05 | 0.10 | 0.10 | 0.15 | 0.05 | 0.05 | 0.15 | 0.10 |
| Resin thickness (mm) | 0.20 | 0.20 | 0.10 | 0.20 | 0.10 | 0.10 | 0.20 | 0.08 | 0.08 |
| Appearance evaluation results | ○ | ○ | X | X | X | X | X | X | X |
| Structure evaluation results | X | X | X | X | X | X | X | X | X |

Figure 2A:
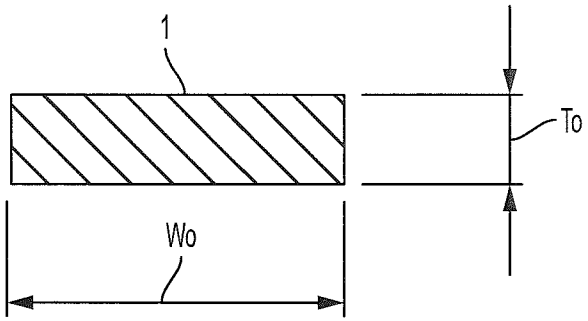
FIGS. 2A and 2B are model diagrams illustrating the cross-sectional surface of the flexible flat cable manufactured in the example.
Figure 2B:
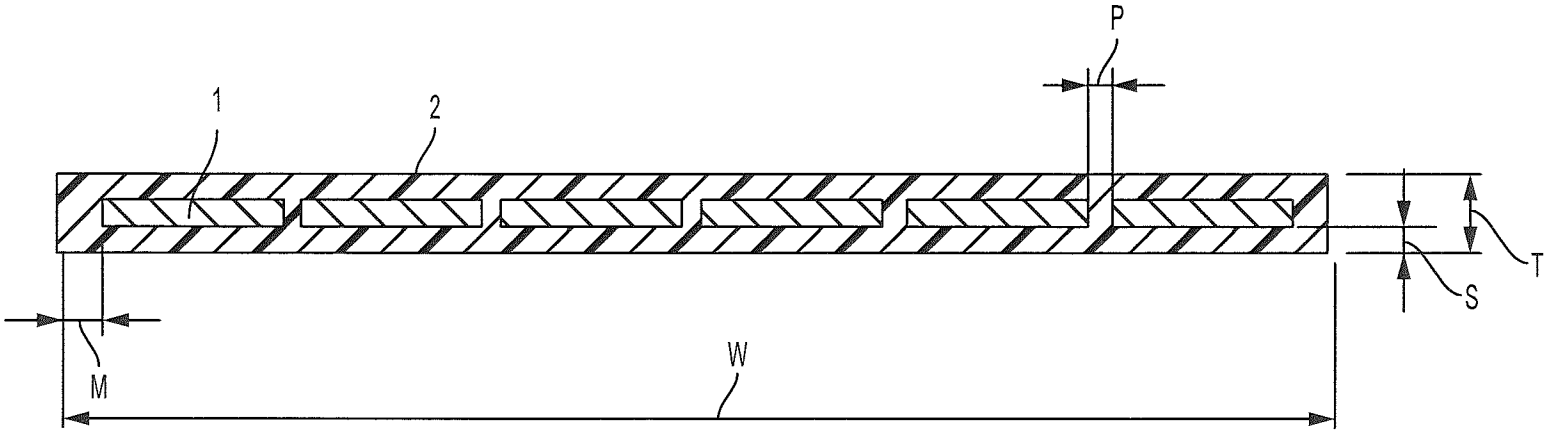

Next, using 12 kinds of the resin compositions, flexible flat cables (a model of the cross-sectional surface is shown in FIG. 1) were manufactured respectively through an extrusion method. Specifically, six straight angle conductors composed of electrical copper having a width Wo of 2.0 mm and a thickness To of 0.15 mm, six straight angle conductors having a width Wo of 2.0 mm and a thickness To of 0.10 mm, or six straight angle conductors having a width Wo of 2.0 mm and a thickness To of 0.05 mm were arrayed in parallel in the width direction so that the inter-conductor distance P shown in FIG. 2B became 0.5 mm, and extrusion was performed around the straight angle conductors at an extrusion temperature set to a temperature at which favorable extrusion was available for each of the resin compositions and a linear rate of 50 m/minute to 200 m/minute using an extruder so that an insulating layer had a width W of 15.5 mm, and a thickness S of 0.20 mm, 0.10 mm, or 0.08 mm at portions in which the conductors were present under a temperature condition (180° C.) at which the respective resin can be molded, thereby obtaining a total of 36 kinds of flexible flat cables shown in Tables 2 to 7 respectively.

Meanwhile, the tables describe the molding temperatures during the extrusion, that is, the die swell ratios at 200° C., and the melt tensions of the respective polyvinyl chloride resin compositions at 190° C.

The appearances and structures of the flexible flat cables obtained in the above were evaluated.

<Appearance Evaluation>

The obtained flexible flat cables were visually observed, and flexible flat cables in which there was no deformation or twisting in the appearance, and there was no floating or peeling of the resin occurring on the surfaces of the conductors were evaluated to be favorable with a sign of "O," and flexible flat cables in which any of deformation, twisting, floating, or peeling occurred were evaluated to be insufficient with a sign of "X" respectively.

<Structure Evaluation>

With regard to the thickness of the insulating layer, the obtained flexible flat cables were implanted in a resin at intervals of 50 m, that is, the vicinity of the cut portions were implanted in an epoxy resin and each section of epoxy resin was cut in advance in order to prevent the cable from collapsing, then, the cut surfaces were polished, surfaces which were not deformed due to cutting were observed using a microscope, and the thicknesses of the insulating layer at the conductor portion were measured. Flexible flat cables for which the measured thickness values were all within ±0.05 mm from the designed value (0.20 mm or 0.08 mm in the example) were evaluated to obtain a stabilized flexible flat cable structure with a sign of "O," and flexible flat cables for which the measured thickness values were not within ±0.05 mm were evaluated to fail to obtain a stabilized flexible flat cable structure with a sign of "X" respectively.

The evaluation results were all shown in Tables 2 to 4.

According to the tables, it is possible to understand that the flexible flat cables according to the invention are flexible flat cables that are excellent in terms of appearance and structure, and can be stably manufactured.

It is apparent that various modifications can be made in the invention within a scope not deviating from the gist of the invention.

The present invention is useful for providing a method of manufacturing a flexible flat cable in which a thin flexible flat cable having an insulating layer with a thickness of 0.2 mm or less on a portion in which a conductor is present which is required for the use of, for example, a narrow cable routing space for automobiles can be stably obtained, and for providing a flexible flat cable which becomes more flexible (flexibility) than a product of the related art through the decrease in the thickness.

What is claimed is:

1. A flexible flat cable comprising:

a plurality of conductors arrayed in parallel with each other; and an insulating layer coating each of the plurality of conductors, wherein the insulating layer comprises an extruded vinyl chloride-based resin composition having a die swell ratio of 1.1 or more at a molding temperature during extrusion, the molding temperature being between 150° C. to 200° C., with a linear rate of between 50 m/minute to 200 m/minute, and wherein the vinyl chloride-based resin composition comprises a polyvinyl chloride base, a plasticizer and a processing aid combination such that a melt tension of the vinyl chloride-based resin composition is 0.02 N to 0.2 N, wherein the processing aid includes at least one of: an acryl-based high-molecular compound, an acryl-based rubber, a polytetrafluoroethylene-based rubber and a silicone acryl complex rubber.

2. The flexible flat cable according to claim 1, wherein a thickness of each of the plurality of conductors is 0.02 mm to 0.5 mm in a thickness direction of the flexible flat cable, and a thickness of the insulating layer is 0.02 mm to 0.5 mm at portions in which one of the plurality of conductors is present.

3. The flexible flat cable according to claim 1, which is configured to electrically connect a moving portion and a fixed portion of an automobile.

4. A method of manufacturing the flexible flat cable of claim 1, comprising:

arranging the plurality of conductors in parallel with each other; and mixing the polyvinyl chloride base with the plasticizer and the processing aid to form the vinyl chloride-based resin composition having a melt tension between 0.02 N to 0.2 N; and extruding the insulating layer comprised of the vinyl chloride-based resin composition over the plurality of conductors, wherein the vinyl chloride-based resin composition is extruded through a die at a linear rate and at a molding temperature, the molding temperature being between 150° C. to 200° C., the linear rate being between 50 m/minute to 200 m/minute, and a die swell ratio through the die being at least 1.1.

5. A flexible flat cable comprising:

a plurality of conductors arrayed in parallel with each other; and an insulating layer coating each of the plurality of conductors, the insulating layer comprising a vinyl chloride-based resin composition including a polyvinyl chloride base, a plasticizer and a processing aid combination such that a melt tension of the vinyl chloride-based resin composition is 0.02 N to 0.2 N, wherein the processing aid includes at least one of: an acryl-based high-molecular compound, an acryl-based rubber, a polytetrafluoroethylene-based rubber and a silicone acryl complex rubber.

6. The flexible flat cable according to claim 5, wherein a thickness of each of the plurality of conductors is 0.02 mm to 0.5 mm in a thickness direction of the flexible flat cable, and a thickness of the insulating layer is 0.02 mm to 0.5 mm at portions in which one of the plurality of conductors is present.

7. The flexible flat cable according to claim 5, which is configured to electrically connect a moving portion and a fixed portion of an automobile.

8. The flexible flat cable according to claim 5, wherein the vinyl chloride-based resin composition comprises 0.5% to 5% processing aid, by weight.

* * * * *